US010743736B1

(12) United States Patent
Miller

(10) Patent No.: US 10,743,736 B1
(45) Date of Patent: Aug. 18, 2020

(54) HANDLE-STORABLE SPONGE MOP

(71) Applicant: Tracy E. Miller, Fort Plain, NY (US)

(72) Inventor: Tracy E. Miller, Fort Plain, NY (US)

( * ) Notice: Subject to any disclaimer, the term of this patent is extended or adjusted under 35 U.S.C. 154(b) by 56 days.

(21) Appl. No.: 16/265,268

(22) Filed: Feb. 1, 2019

(51) Int. Cl.
*A47L 13/12* (2006.01)
*A47L 13/16* (2006.01)
*A47L 13/257* (2006.01)

(52) U.S. Cl.
CPC ..... *A47L 13/12* (2013.01); *A47L 13/16* (2013.01); *A47L 13/257* (2013.01)

(58) Field of Classification Search
CPC ..... A47L 13/00; A47L 13/10; A47L 13/12; A47L 13/16; A47L 13/20; A47L 13/24; A47L 13/257; A47L 13/42; A47L 13/46; A47L 13/48; A46B 15/0055; A46B 17/00; A46B 17/08; A46B 2200/30; A46B 2200/302
USPC ..... 15/114, 115, 244.1, 244.4; D4/116, 119; D32/40, 42, 50, 51, 52
See application file for complete search history.

(56) References Cited

U.S. PATENT DOCUMENTS

| | | | |
|---|---|---|---|
| 1,360,926 | A | 11/1920 | Glenn |
| 1,476,396 | A | 2/1923 | Dickson |
| 1,838,448 | A | 12/1931 | Pomfret |
| 2,446,814 | A | 8/1948 | Crofton |
| 2,555,858 | A | 6/1951 | Oleksy |
| 2,686,329 | A | 8/1954 | King |

(Continued)

FOREIGN PATENT DOCUMENTS

| | | | |
|---|---|---|---|
| CA | 2314126 | A1 | 1/2001 |
| CN | 201098090 | Y | 8/2008 |

(Continued)

OTHER PUBLICATIONS

Website: https://www.amazon.com/Masthome-Household-Double-side-Microfiber-Cleaning/dp/B07C2LZRGC/ref=sr_1_ sspa?ie=UTF8 &qid=1539661428&sr=8-1-spons&keywords=broom+mop&psc=1 Downloaded Oct. 13, 2018 Masthome Household Printed Double-side Mop, Microfiber Heating Duster, Broom 6 PCS Cleaning Set for Household Cleaning.

(Continued)

*Primary Examiner* — Mark Spisich
(74) *Attorney, Agent, or Firm* — Russ Weinzimmer & Associates, P.C.

(57) ABSTRACT

A handle-storable sponge mop for use at the end of a broom handle. The handle-storable sponge mop includes a sponge mop body shaped as a truncated square right prism having a leading face and a longest rectangular side which together form a leading beveled cleaning edge. A closed-end cylindrical channel extends partially into the sponge mop body perpendicularly through the square base face. The closed-end cylindrical channel receives and securely holds the handle end of the broom handle when the broom handle is fully inserted into the closed-end cylindrical channel. An open cylindrical channel extends completely through the sponge mop body, and can receive the broom handle such that the broom handle can pass through the open cylindrical channel so that the handle-storable sponge mop can be so stored on the broom handle. In some embodiments, the open cylindrical channel is in substantially perpendicular relationship with the closed-end cylindrical channel.

19 Claims, 4 Drawing Sheets

(56) References Cited

U.S. PATENT DOCUMENTS

| | | | | |
|---|---|---|---|---|
| 2,691,788 | A | 1/1960 | Thomasson | |
| 2,919,455 | A | 1/1960 | Turner | |
| 3,054,127 | A | 9/1962 | Petsch et al. | |
| 3,058,139 | A | 10/1962 | Dryden | |
| 3,274,635 | A | 9/1966 | Myers | |
| 3,570,038 | A | 3/1971 | Jones | |
| 3,753,267 | A | 8/1973 | Johnson, Sr. | |
| 4,285,096 | A | 8/1981 | Swaim | |
| 5,351,356 | A | 10/1994 | Townsend, Jr. | |
| 5,799,357 | A | 9/1998 | Taylor | |
| 5,903,948 | A | 5/1999 | Williams et al. | |
| 6,543,081 | B1 | 4/2003 | Cohen | |
| 6,701,567 | B2 | 3/2004 | Smith | |
| 6,735,809 | B2 | 5/2004 | Parks | |
| 6,745,434 | B2 | 6/2004 | Smith et al. | |
| 9,554,685 | B2 | 1/2017 | Gadsden | |
| 2014/0047655 | A1 | 2/2014 | Clayton et al. | |
| 2018/0338664 | A1* | 11/2018 | Park | A47L 13/46 |

FOREIGN PATENT DOCUMENTS

| | | | |
|---|---|---|---|
| CN | 201320134 | Y | 10/2009 |
| CN | 201356515 | Y | 12/2009 |
| CN | 202942047 | U | 11/2012 |
| CN | 103082957 | A | 5/2013 |
| CN | 203789857 | U | 12/2013 |
| CN | 204158327 | U | 10/2014 |
| EP | 1419726 | B1 | 5/2004 |
| GB | 2255900 | A | 5/1991 |
| JP | 2005-312494 | * | 11/2005 |

OTHER PUBLICATIONS

Website: https://www.wholesalejanitorialsupply.com/lysol-brand-lysol-sponge-mop-9-48-steel-handle/ Downloaded Oct. 13, 2018 Lysol Sponge Mop "Steel Handle".

Website: http://www.super-cool-products.com/broomandmicrofibermop.html Downloaded Oct. 13, 2018 The Super® Rubber Broom and Microfiber Mop One Steel Telescopic Handle and Screw-On Rubber Broom and Microfiber Mop.

Website: https://www.youbeli.com/korean-double-sided-mop-26amp3b-broom-p-1680704.html Downloaded Oct. 13, 2018 Korean Double-Sided Mop & Broom.

Website: https://www.filenesbasement.com/product/housekeeping-laundry/415382-3496/bulk-buys-dual-head-auto-brush-case-of-24.html Downloaded Oct. 13, 2018 Dual Head Auto Brush.

* cited by examiner

HANDLE-STORABLE SPONGE MOP

FIELD OF THE INVENTION

This invention relates generally to mops, and more particularly to sponge mops.

BACKGROUND OF THE INVENTION

There is a need for an easier way to clean kitchen and bathroom edges and corners after using a broom, a regular mop, or a steamer mop to clean a floor surface. The dirt left by any mop, i.e., steamer mops, flat mops, string mops, or mopping systems with pad refills, is too much to just leave on the floor. Consequently, it is often necessary to carefully bend over, or get on hands and knees with a wet paper towel, to wipe the dirt by hand that got pushed into the corners after using any of a variety of mops for floor cleaning.

Also, when using a typical mop, it is problematic when one needs to place the mop to allow it to dry. If the mop is stored upside down to prevent the wet mop from touching the floor, the mop is likely to fall over. If the wet mop is allowed to rest on the floor while it dries, an unsanitary condition is created where the damp mop can damage the floor and/or promote bacterial growth and mold.

SUMMARY OF THE INVENTION

The invention is a handle-storable sponge mop made from a multipurpose sponge, such as a sponge made of polyurethane, that has been cut so as to have a beveled tip or edge. Brooms having a long cylindrical handle are commonly found in most houses. The handle-storable sponge mop of the invention can be stored on the handle of a broom, for example, using a cylindrical channel that extends though the sponge mop. Thus, the handle-storable sponge mop can be mounted on the handle of the broom by inserting the handle into the cylindrical channel that extends though the sponge mop.

The handle-storable sponge mop of the invention can be stored on a broom handle or standard mop handle while not in use, and can be mounted on the end of the handle for use. Thus, the handle enables the handle-storable sponge mop to be guided into the corners and edges of floors without requiring kneeling or crawling on a damp floor to clean all the dirt pushed into the corners and edges.

The handle-storable sponge mop of the invention is especially useful for doing quick spot and spill clean ups without getting on the floor with a paper towel, or getting out a regular mop just for a small clean up.

The open cylindrical channel that extends through the sponge mop makes it possible to store the sponge mop when it's wet, without contacting and/or contaminating any surface, such as a wall or the floor.

The open cylindrical channel of the sponge mop also makes it possible to store multiple sponge mops on a single broom handle. Further, each sponge mop can be used to clean a different surface using a different cleaning solution. For example, one sponge mop can be used to clean the outdoor porch using a strong outdoor cleaning solution, and another sponge mop can be used to clean the indoor kitchen floor, using a milder indoor cleaning solution, such as a light vinegar solution with hot water. To distinguish each of the sponge mops from the other, each sponge mop can be a different color.

The sponge mop requires no special handle or attachment device. It can fit onto almost any style broom handle, thereby converting that broom into a working mop as well.

The sponge mop is easy to attach to the end of a broom handle, and is also easy to remove and clean, because there are no screws, cords, snaps, or ties required to hold the sponge mop to the broom handle.

The sponge mop is very sanitary because it facilitates sanitary air drying, thereby eliminating the dilemma of where to put a wet or damp mop after use.

Multiple sponge mops can be stored and used on a single cleaning tool, such as a broom, so that one can use a variety of different cleaning agents on each mop.

The sponge mop has a beveled cleaning edge configured to extend into edges and corners.

When the sponge mop is applied to the end of a broom handle, the handle is inserted into a closed-end channel of the sponge mop, thereby providing support for scrubbing pressure.

The sponge mop effectively converts a standard broom into a dual action mop and broom combination.

The sponge mop is easy to clean, because it's simple to remove from the broom handle, it's lightweight, and it fits easily in one's hands.

The sponge mop can be made from polyurethane foam, which is more hygienic than cellulose sponges, which become stiff over time, and start to smell bad as they tend to breed bacteria.

The handle-storable sponge mop is lightweight, has no sharp parts that could cause injury, and has no moving parts to break.

A general aspect of the invention is a handle-storable sponge mop for use at a handle end of a broom handle. The handle-storable sponge mop includes: a sponge mop body shaped as a truncated prism, the truncated prism having a base face, a leading face, a longest rectangular side, a shortest rectangular side, and a pair of right-trapezoidal sides, the leading face and the longest rectangular side together forming a leading beveled cleaning edge; a closed-end channel extending partially through the sponge mop body, the closed-end channel having an open end and a closed end, the open end being in the base face, the closed end being where the closed-end channel terminates within the sponge mop body, the open end configured to receive the handle end of the broom handle, the closed end configured to receive and securely hold the handle end of the broom handle when the broom handle is fully inserted into the closed-end channel; and an open channel extending completely through the sponge mop body, the open channel being configured to receive the broom handle such that the broom handle can pass through the open channel.

In some embodiments, the closed-end channel extends perpendicularly into the base face of the sponge mop body.

In some embodiments, the closed-end channel and the open channel are cylindrical channels.

In some embodiments, the closed-end channel and the open channel intersect.

In some embodiments, the closed-end channel and the open channel are in substantially perpendicular relationship.

In some embodiments, the open channel extends between the longest rectangular side and the shortest rectangular side.

In some embodiments, the open channel extends perpendicularly between the longest rectangular side and the shortest rectangular side.

In some embodiments, the open channel extends between the pair of right-trapezoidal sides.

In some embodiments, the open channel extends perpendicularly between the pair of right-trapezoidal sides.

In some embodiments, the truncated prism is one of: a triangular truncated prism, a square truncated prism, a rectangular truncated prism, a hexagonal truncated prism, an octagonal truncated prism.

In some embodiments, the base face is one of: a triangle, a square, a rectangle, a hexagon, an octagon.

In some embodiments, the truncated prism is a truncated right prism in which the longest rectangular side, the shortest rectangular side, and the pair of right-trapezoidal sides are perpendicular to the base face.

In some embodiments, the sponge mop body is made entirely of absorbent material.

In some embodiments, the absorbent material is selected from: polyurethane foam, foam rubber sponge material, microfiber textile, stranded cotton, stranded synthetic fiber, and stranded Rayon.

Another general aspect of the invention is a handle-storable sponge mop for use at a handle end of a broom handle. This handle-storable sponge mop includes: a sponge mop body shaped as a truncated square right prism, the truncated square right prism having a square base face, a leading face, a longest rectangular side, a shortest rectangular side, and a pair of right-trapezoidal sides, the leading face and the longest rectangular side together forming a leading beveled cleaning edge; a closed-end cylindrical channel extending partially through the sponge mop body, the closed-end cylindrical channel having an open end and a closed end, the open end being in the base face, the closed end being where the closed-end cylindrical channel terminates within the sponge mop body, the closed-end cylindrical channel extending perpendicularly into the base face of the sponge mop body, the open end configured to receive the handle end of the broom handle, the closed end configured to receive and securely hold the handle end of the broom handle when the broom handle is fully inserted into the closed-end cylindrical channel; and an open cylindrical channel extending completely through the sponge mop body, the open cylindrical channel being configured to receive the broom handle such that the broom handle can pass through the open cylindrical channel, the open cylindrical channel being in substantially perpendicular relationship with the closed-end cylindrical channel.

In some embodiments, the closed-end cylindrical channel and the open cylindrical channel intersect.

In some embodiments, the open cylindrical channel extends between the longest rectangular side and the shortest rectangular side.

In some embodiments, the open cylindrical channel extends between the pair of right-trapezoidal sides.

In some embodiments, the sponge mop body is made entirely of absorbent polyurethane foam.

BRIEF DESCRIPTION OF THE DRAWINGS

The invention will be more fully understood from the following detailed description, in conjunction with the following figures, wherein.

DETAILED DESCRIPTION

Figure 1A:
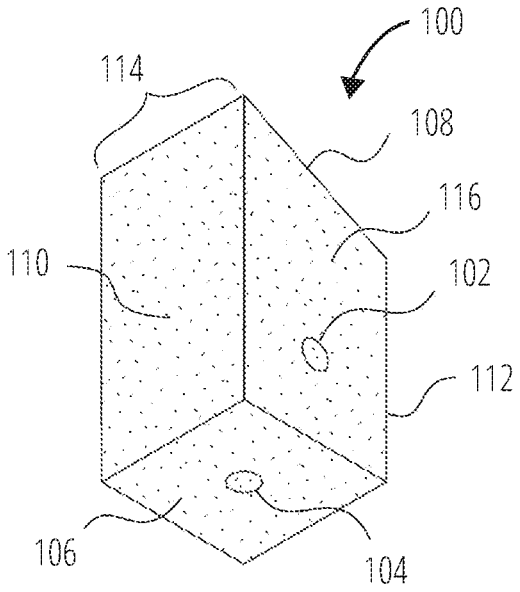
FIG. 1A is an isometric view of an embodiment of the handle-storable sponge mop, showing an open channel and a closed-end channel, each channel for receiving a broom handle.
Figure 2:
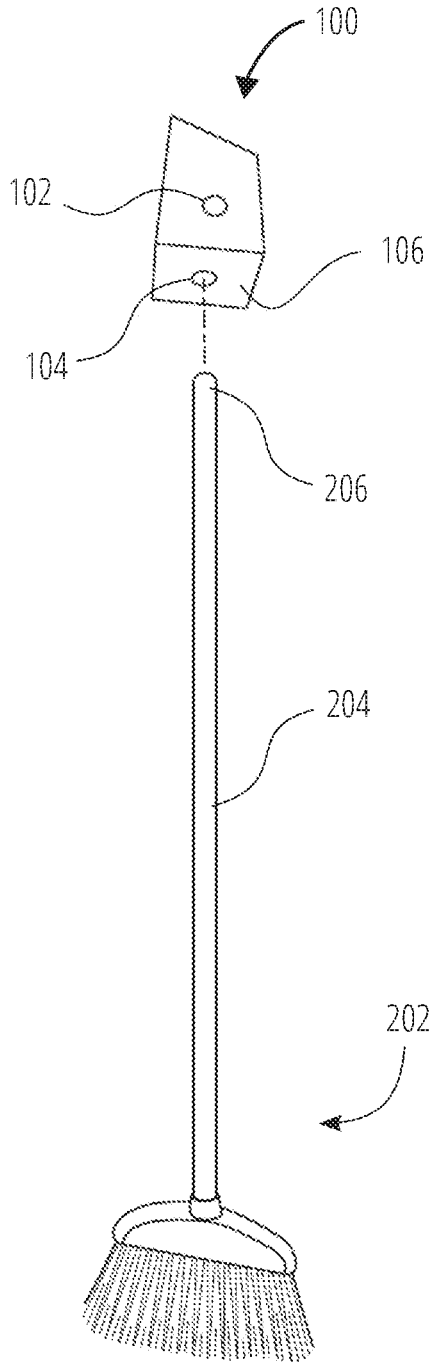
FIG. 2 is a perspective exploded view of the handle-storable sponge mop embodiment of FIG. 1A, showing how the handle-storable sponge mop fits onto a broom handle using the closed-end channel.

With reference to FIG. 1A, an isometric view of an embodiment of a handle-storable sponge mop 100 is shown having an open channel 102 and a closed-end channel 104, each channel for receiving a broom handle 204 (shown in FIG. 2). The handle-storable sponge mop 100 is shaped as a truncated prism, including a base face 106, a leading face 108 (partially obscured in this view), a longest rectangular side 110, a shortest rectangular side 112 (partially obscured in this view), a leading beveled cleaning edge 114, and a pair of right-trapezoidal sides 116. The leading face 108 and the longest rectangular side 110 together form the leading beveled cleaning edge 114. The open channel 102 extends between and through the pair of right-trapezoidal sides 116. The closed-end channel 104 extends into the base face 106.

In some embodiments, the base face 106 is one of: a square, a rectangle, a triangle, a hexagon, an octagon.

Figure 1B:
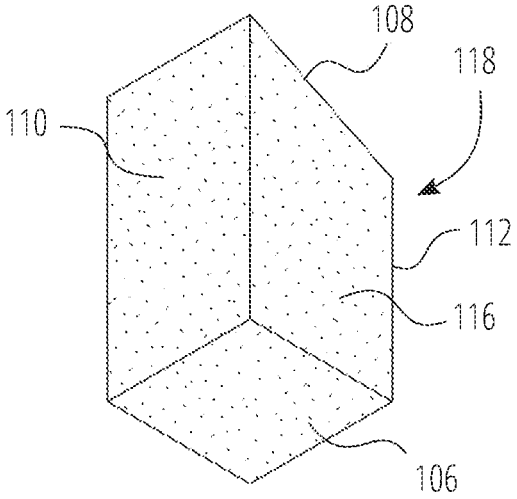
FIG. 1B is an isometric view of the sponge mop body of the handle-storable sponge mop embodiment of FIG. 1A.

With reference to FIG. 1B, an isometric view of a sponge mop body 118 is shown. The sponge mop body 118 is shaped as a square truncated prism. In other embodiments, the sponge mop body 118 can be one of: a rectangular truncated prism, a triangular truncated prism, a hexagonal truncated prism, or an octagonal truncated prism. Forming the open channel 102 and the closed-end channel 104 of FIG. 1 in the sponge mop body 118 of FIG. 1B results in the handle-storable sponge mop 100 of FIG. 1A.

In the embodiment shown in FIG. 1B, since the truncated prism is a square truncated prism, the longest rectangular side 110, the shortest rectangular side 112, and the pair of right-trapezoidal sides 116 are perpendicular to the base face 106.

In this embodiment, the sponge mop body 118 is made entirely of absorbent material. In some embodiments, the absorbent material is selected from: polyurethane foam, foam rubber sponge material, microfiber textile, stranded cotton, stranded synthetic fiber, and stranded Rayon.

Figure 1C:
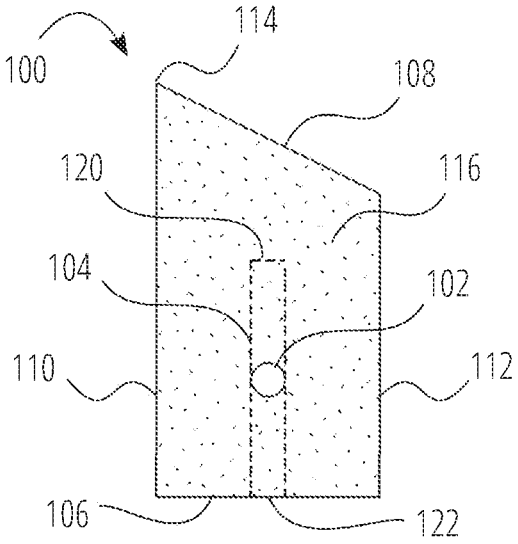
FIG. 1C is a side view of the handle-storable sponge mop embodiment of FIG. 1A.

With reference to FIG. 1C, a left side view of an embodiment of the handle-storable sponge mop 100 is shown, including hidden lines that show the closed end 120 and the open end 122 of the closed-end channel 104 extending perpendicularly into the base face 106. In this embodiment, the base face 106, the leading face 108, the longest rectangular side 110, the shortest rectangular side 112, together form the pair of right-trapezoidal sides 116.

The open channel 102 perpendicularly extends between and through the two right-trapezoidal sides 116. In alternative embodiments, the open channel 102 can extend perpendicularly between the longest rectangular side 110 and the shortest rectangular side 112.

Figure 1D:
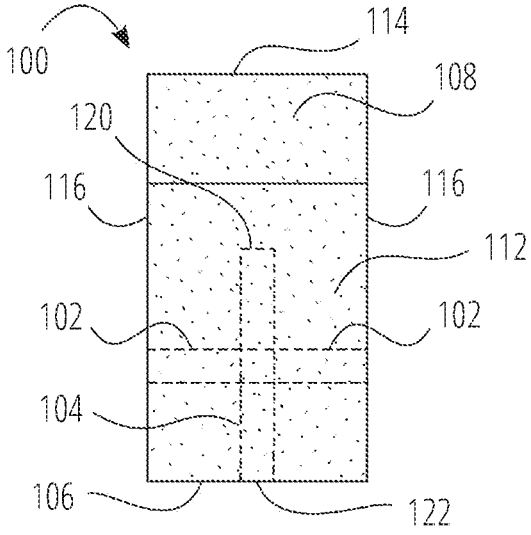
FIG. 1D is a front view of the handle-storable sponge mop embodiment of FIG. 1A.

With reference to FIG. 1D, a front view of an embodiment of the handle-storable sponge mop 100 is shown, including hidden lines that show the closed end 120 and the open end 122 of the closed-end channel 104, and the open channel 102. The handle-storable sponge mop 100 also includes the base face 106, the leading face 108, the shortest rectangular side 112, the leading beveled cleaning edge 114, and a pair of right-trapezoidal sides 116.

In this embodiment, the open channel 102 extends perpendicularly between the pair of right-trapezoidal sides 116. In alternative embodiments, the open channel 102 can extend between the pair of right-trapezoidal sides 116 at an angle other than a perpendicular angle.

In this embodiment, the open channel 102 and the closed-end channel 104 are cylindrical channels. In alternate embodiments, the open channel 102 and the closed-end channel 104 can be triangular, square, pentagonal, hexagonal, or octagonal channels. In this embodiment, the open channel 102 and the closed-end channel 104 intersect, but in other embodiments, the open channel 102 can extend between the pair of right-trapezoidal sides 116 without intersecting with the closed-end channel 104. In this embodiment, the open channel 102 and the closed-end channel 104 are in substantially perpendicular relationship, but in other embodiments, the open channel 102 can be in non-perpendicular relationship with the closed-end channel 104.

With reference to FIG. 2, a perspective exploded view of the handle-storable sponge mop 100 is shown, showing how the handle-storable sponge mop 100 fits onto a handle end 206 of a broom handle 204 of a broom 202 using the closed-end channel 104. The closed-end channel 104 extends perpendicularly into the base face 106 of the handle-storable sponge mop 100, and the closed-end channel 104 is configured to receive the handle end 206 so as to allow the handle end 206 to abut against the closed end of the closed-end channel 104. Consequently, when in use, pushing the broom handle 204 forward into the handle-storable sponge mop 100 results in pushing the handle-storable sponge mop 100 forward. In this manner, the handle-storable sponge mop 100 can be manipulated and controlled by manipulating the broom handle 204.

Figure 4A:
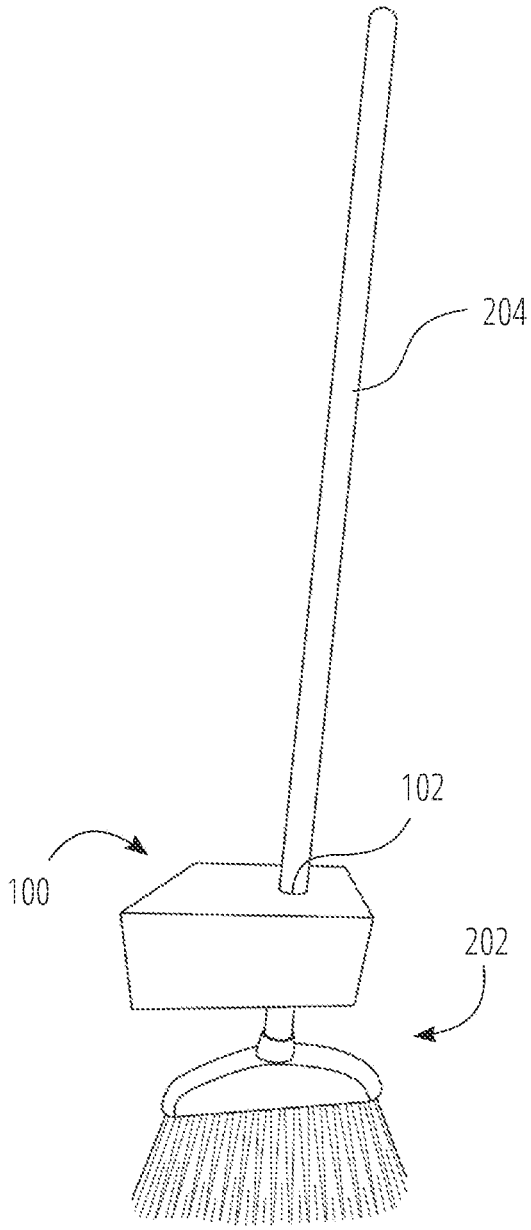
FIG. 4A is a perspective view of the broom of FIG. 2, having a handle-storable sponge mop stored on the broom handle of a broom, showing the broom handle extending through the open channel of the handle-storable sponge mop.
Figure 4B:
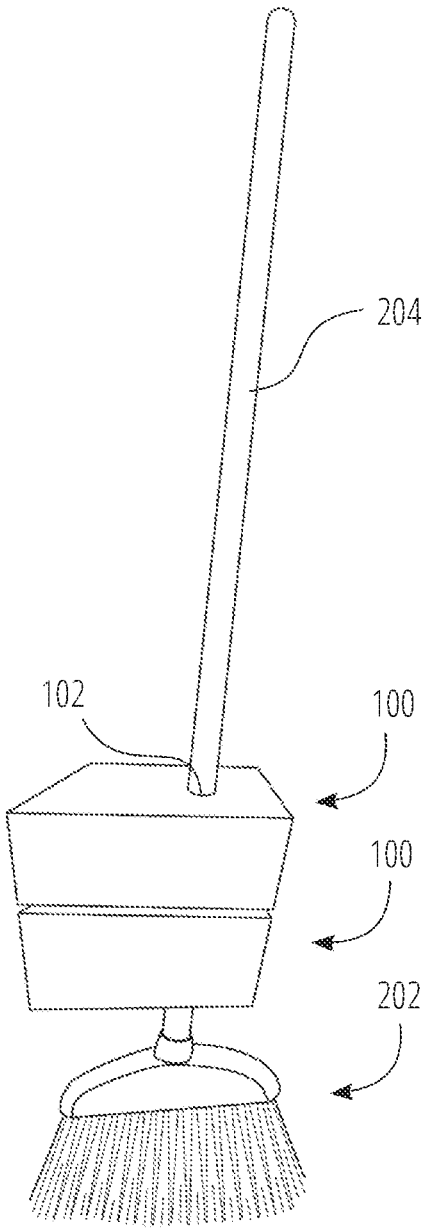
FIG. 4B is a perspective view of the broom of FIG. 4A, having two handle-storable sponge mops stored on the broom handle of the broom, showing the broom handle extending through the open channel of each handle-storable sponge mop stored thereon.

Also shown is the open channel 102, which can be used to store the handle-storable mop 100 on the broom handle 204, as shown in FIGS. 4A and 4B.

Figure 3:
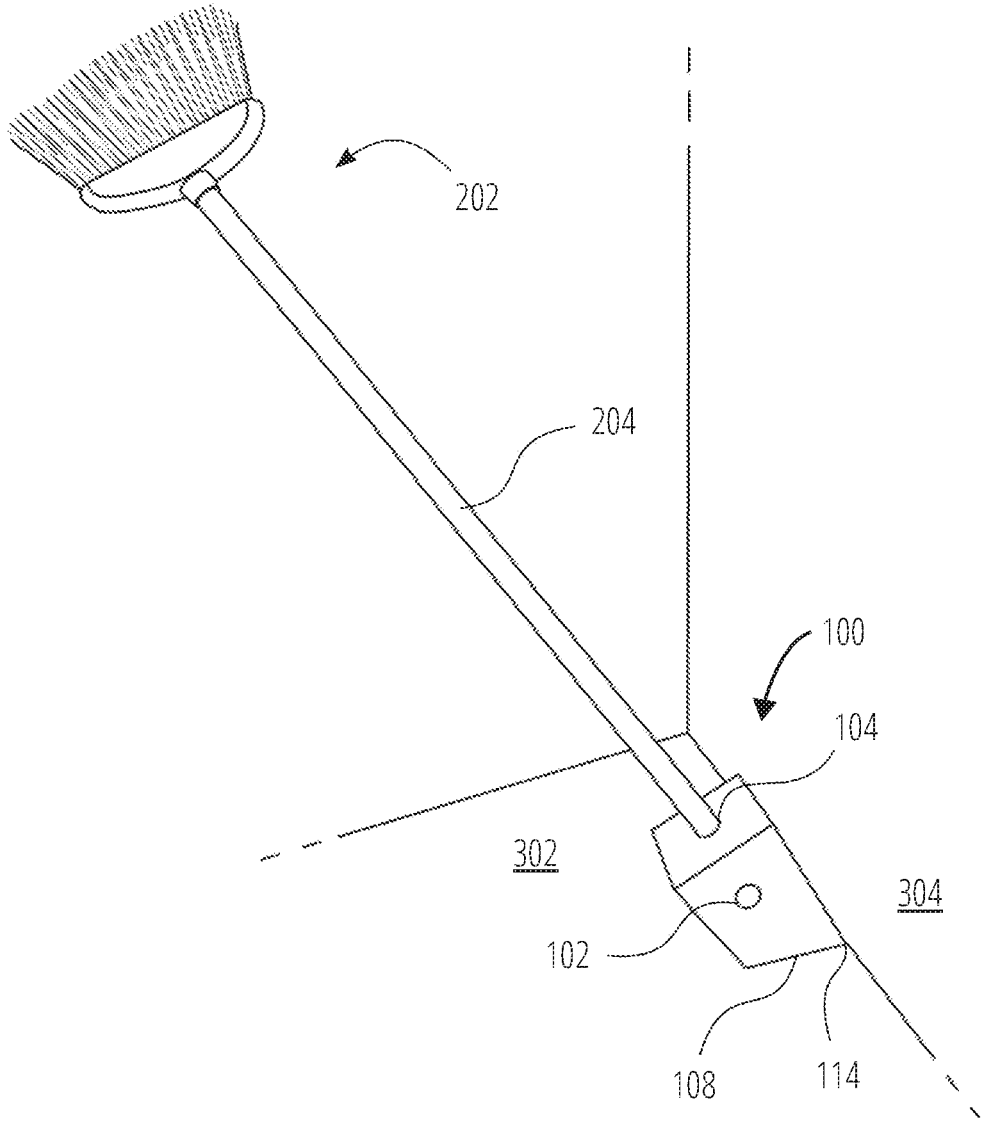
FIG. 3 is a perspective view of the broom handle of the broom of FIG. 2 inserted into the closed-end channel of the handle-storable sponge mop of FIG. 2, and in position for cleaning an edge of a floor using the beveled cleaning edge of the handle-storable sponge mop.

With reference to FIG. 3, a perspective view of the broom handle 204 of the broom 202 of FIG. 2 inserted into the closed-end channel 104 of the handle-storable sponge mop 100 is shown. The handle-storable sponge mop 100 is in position for use to clean the corner formed by an edge of a room floor 302 and a bottom portion of a room wall 304 using the leading beveled cleaning edge 114 and the leading face 108 of the handle-storable sponge mop 100.

Also shown is the open channel 102, which can be used to store the handle-storable mop 100 on the broom handle 204, as shown in FIGS. 4A and 4B.

With reference to FIG. 4A, a perspective view of the broom of FIG. 2 having a handle-storable sponge mop 100 stored on the broom handle 204 of a broom 202 is shown. The broom handle 204 is inserted into and completely through the open channel 102 of the handle-storable sponge mop 100.

With reference to FIG. 4B, a perspective view of the broom of FIG. 2, having two handle-storable sponge mops 100 stored on the broom handle 204 of the broom 202, showing the broom handle 204 inserted into and completely through the open channel 102 of each handle-storable sponge mop 100 stored thereon.

Other modifications and implementations will occur to those skilled in the art without departing from the spirit and the scope of the invention as claimed. Accordingly, the above description is not intended to limit the invention, except as indicated in the following claims.

What is claimed is:

1. A handle-storable sponge mop for use at a handle end of a broom handle, the handle-storable sponge mop comprising:

a sponge mop body shaped as a truncated prism, the truncated prism having a base face, a leading face, a longest rectangular side, a shortest rectangular side, and a pair of right-trapezoidal sides, the leading face and the longest rectangular side together forming a leading beveled cleaning edge;

a closed-end channel extending partially through the sponge mop body, the closed-end channel having an open end and a closed end, the open end being in the base face, the closed end being where the closed-end channel terminates within the sponge mop body, the open end configured to receive the handle end of the broom handle, the closed end configured to receive and securely hold the handle end of the broom handle when the broom handle is fully inserted into the closed-end channel; and an open channel extending completely through the sponge mop body, the open channel being configured to receive the broom handle such that the broom handle can pass through the open channel.

2. The handle-storable sponge mop of claim 1, wherein the closed-end channel extends perpendicularly into the base face of the sponge mop body.

3. The handle-storable sponge mop of claim 1, wherein the closed-end channel and the open channel are cylindrical channels.

4. The handle-storable sponge mop of claim 1, wherein the closed-end channel and the open channel intersect.

5. The handle-storable sponge mop of claim 1, wherein the closed-end channel and the open channel are in substantially perpendicular relationship.

6. The handle-storable sponge mop of claim 1, wherein the open channel extends between the longest rectangular side and the shortest rectangular side.

7. The handle-storable sponge mop of claim 1, wherein the open channel extends perpendicularly between the longest rectangular side and the shortest rectangular side.

8. The handle-storable sponge mop of claim 1, wherein the open channel extends between the pair of right-trapezoidal sides.

9. The handle-storable sponge mop of claim 1, wherein the open channel extends perpendicularly between the pair of right-trapezoidal sides.

10. The handle-storable sponge mop of claim 1, wherein the truncated prism is one of: a triangular truncated prism, a square truncated prism, a rectangular truncated prism, a hexagonal truncated prism, an octagonal truncated prism.

11. The handle-storable sponge mop of claim 1, wherein the base face is one of: a triangle, a square, a rectangle, a hexagon, an octagon.

12. The handle-storable sponge mop of claim 1, wherein the truncated prism is a truncated right prism in which the longest rectangular side, the shortest rectangular side, and the pair of right-trapezoidal sides are perpendicular to the base face.

13. The handle-storable sponge mop of claim 1, wherein the sponge mop body is made entirely of absorbent material.

14. The handle-storable sponge mop of claim 13, wherein the absorbent material is selected from: polyurethane foam, foam rubber sponge material, microfiber textile, stranded cotton, stranded synthetic fiber, and stranded Rayon.

15. A handle-storable sponge mop for use at a handle end of a broom handle, the handle-storable sponge mop comprising:

a sponge mop body shaped as a truncated square right prism, the truncated square right prism having a square base face, a leading face, a longest rectangular side, a shortest rectangular side, and a pair of right-trapezoidal sides, the leading face and the longest rectangular side together forming a leading beveled cleaning edge;

a closed-end cylindrical channel extending partially through the sponge mop body, the closed-end cylindrical channel having an open end and a closed end, the open end being in the base face, the closed end being where the closed-end cylindrical channel terminates within the sponge mop body, the closed-end cylindrical channel extending perpendicularly into the base face of the sponge mop body, the open end configured to receive the handle end of the broom handle, the closed end configured to receive and securely hold the handle end of the broom handle when the broom handle is fully inserted into the closed-end cylindrical channel; and an open cylindrical channel extending completely through the sponge mop body, the open cylindrical channel being configured to receive the broom handle such that the broom handle can pass through the open cylindrical channel, the open cylindrical channel being in substantially perpendicular relationship with the closed-end cylindrical channel.

16. The handle-storable sponge mop of claim 15, wherein the closed-end cylindrical channel and the open cylindrical channel intersect.

17. The handle-storable sponge mop of claim 15, wherein the open cylindrical channel extends between the longest rectangular side and the shortest rectangular side.

18. The handle-storable sponge mop of claim 15, wherein the open cylindrical channel extends between the pair of right-trapezoidal sides.

19. The handle-storable sponge mop of claim 15, wherein the sponge mop body is made entirely of absorbent polyurethane foam.

* * * * *